US005829520A

United States Patent [19]

Johnson

[11] Patent Number: 5,829,520

[45] Date of Patent: Nov. 3, 1998

[54] METHOD AND APPARATUS FOR TESTING, COMPLETION AND/OR MAINTAINING WELLBORES USING A SENSOR DEVICE

[75] Inventor: Michael H. Johnson, Spring, Tex.

[73] Assignee: Baker Hughes Incorporated, Houston, Tex.

[21] Appl. No.: 668,763

[22] Filed: Jun. 24, 1996

Related U.S. Application Data

[63] Continuation-in-part of Ser. No. 388,663, Feb. 14, 1995.

[51] Int. Cl.[6] ..... E21B 47/00

[52] U.S. Cl. ..... 166/250.01; 166/66; 166/252.2; 173/152.06

[58] Field of Search ..... 166/250.01, 252.2, 166/66; 73/152.06, 152.54, 866.1, 431

[56] References Cited

U.S. PATENT DOCUMENTS

| | | | |
|---|---|---|---|
| 2,391,609 | 12/1945 | Wright | 166/229 |
| 2,540,123 | 2/1951 | Kinley | 166/229 |
| 2,707,997 | 5/1955 | Zandmer et al. | 166/100 |
| 2,775,304 | 12/1956 | Zandmer et al. | 166/100 |
| 2,855,049 | 10/1958 | Zandmer et al. | 166/100 |
| 3,209,588 | 10/1965 | Terry . | |
| 3,326,291 | 6/1967 | Zandmer et al. | 166/100 |
| 3,347,317 | 10/1967 | Zandmer et al. | 166/100 |
| 4,716,973 | 1/1988 | Cobern | 166/66 X |
| 4,744,438 | 5/1988 | Ruzie et al. | 166/66 |
| 4,915,172 | 4/1990 | Donovan et al. | 166/278 |
| 5,130,705 | 7/1992 | Allen et al. | 166/66 X |
| 5,165,478 | 11/1992 | Wilson | 166/297 |
| 5,186,255 | 2/1993 | Corey | 166/66 X |
| 5,224,556 | 7/1993 | Wilson et al. | 175/4.53 |
| 5,228,518 | 7/1993 | Wilson et al. | 166/369 |
| 5,243,562 | 9/1993 | Laurent et al. | 166/250.16 X |
| 5,251,708 | 10/1993 | Perry et al. | 166/66 X |

FOREIGN PATENT DOCUMENTS

| | | |
|---|---|---|
| 433110 | 11/1990 | European Pat. Off. . |
| 533526 | 9/1992 | European Pat. Off. . |
| 774565 | 11/1996 | European Pat. Off. . |
| 2185574 | 7/1987 | United Kingdom . |

*Primary Examiner*—William P. Neuder
*Attorney, Agent, or Firm*—Rosenblatt & Redano P.C.

[57] ABSTRACT

The present invention is an improved method and apparatus for testing and monitoring wellbore operations. The invention is (1) a data acquisition device capable of monitoring, recording wellbore and/or reservoir characteristics while capable of fluid flow control; and (2) a method of monitoring and/or recording at least one downhole characteristic during testing, completion and/or maintenance of a wellbore. The invention includes an assembly within a casing string comprising a sensor probe having an optional flow port allowing fluid flow while sensing wellbore and/or reservoir characteristics. It also includes a microprocessor, a transmitting device, and a controlling device located in the casing string for processing and transmitting real time data. A memory device is also provided for recording data relating to the monitored wellbore or reservoir characteristics. Examples of downhole characteristics which may be monitored include: temperature, pressure, fluid flow rate and type, formation resistivity, cross-well and acoustic sesmometry, perforation depth, fluid characteristic or logging data. With the microprocessor, hydrocarbon production performance maybe enhanced by activating local operations in additional associated downhole equipment, e.g., water shut-off operations at a particular zone, maintaining desired performance of a well by controlling flow in multiple wellbores, zone mapping on a cumulative basis, flow control operations, spacing casing and its associated flow ports in multiple zone wellbores, maintaining wellbore and/or reservoir pressure, sensing perforation characteristics, sensing reservoir characteristics or any number of other operations.

53 Claims, 6 Drawing Sheets

METHOD AND APPARATUS FOR TESTING, COMPLETION AND/OR MAINTAINING WELLBORES USING A SENSOR DEVICE

CROSS-REFERENCE OF RELATED APPLICATIONS

The present application is a continuation-in-part of the following pending patent application in the United States Patent Office: U.S. patent application Ser. No. 08/388663 entitled "Method and Apparatus for Completing Wells," filed Feb. 14, 1995.

BACKGROUND OF THE INVENTION

This invention relates to a method of testing, completing and maintaining a hydrocarbon wellbore. More particularly, but not by way of limitation, this invention relates to a method and apparatus for placing within a wellbore, a flow control device containing a sensor for monitoring, testing a wellbore and/or controlling the flow of hydrocarbons from a reservoir.

The production for oil and gas reserves has taken the industry to remote sites including inland and offshore locations. Historically, the cost for developing and maintaining hydrocarbon production has been very high, and as the production for hydrocarbons continues to occur in these remote and deep water areas, costs have escalated because of the amount of equipment, personnel and logistics required in these areas.

Production wells will often encounter several hydrocarbon zones within a reservoir and multiple wellbores must be utilized to exploit and recover the hydrocarbon reserves. During the productive life of these wells, the well must be tested and information retrieved concerning the wellbore and/or reservoir characteristics including hydrocarbon analysis so that hydrocarbon production and retrieval is performed in the most efficient manner and at maximum capacity. Well operators desire maximum recovery from productive zones, and in order to maximize production, proper testing, completion and control of the well is required.

Many hydrocarbon reservoirs by their nature comprise consolidated or unconsolidated rock and/or sandstone, water, oil, gas or condensate. Thus, these formations may produce sand particles and other debris that can cause erosion and other problems in the wellbore and at the surface facility, as well as water, gas, etc. which generally affect the productivity of the well. Therefore, various devices for preventing and/or monitoring production from the reservoir into the wellbore have been developed in the past.

One common method is to place instruments on the surface such as production platforms and run sensors into the wellbore through a wireline or coil tubing methods. The data collected through these wireline and surface sensors are used to ascertain the performance of a wellbore within a particular reservoir area. These information retrieval methods and subsequent assessment of such information is well known in the industry and to those of ordinary skill in the art and the clear disadvantages are also apparent.

These current techniques for wellbore and reservoir data collection include time consuming procedures of positioning a wireline or coil tubing rig or unit on a surface vehicle or platform to suspend a sensor or a set of sensors and taking readings. Subsequently, the sensors are withdrawn and data analyzed. During all the performance of these operations, hydrocarbon production is interrupted because of safety, environmental and/or rig-up issues. It is clear to those in the industry that enormous costs are involved in not only delaying production but also having to incur costs for simply obtaining the wellbore or reservoir information from the wellbore.

An illustrative list of the disadvantages therefor the above procedure follows. First, production is lost for a certain time period while on-going rig or platform costs remain. This shut-off in hydrocarbon production has considerable impact on many high volume operators affecting profitability of the well. Additionally, the risks of wellbore damage clearly exist due to the possibility of lost tools and equipment in the wellbore. Again, in such circumstances, hydrocarbon production is lost and additional costs are incurred in restoring the wellbore by removing the lost equipment through additional services. Second, the equipment and logistics relating to wireline and coiled tubing operations in many deep water and remote areas make this type of data gathering procedure a costly exercise since the formation is exposed to damaging drilling and/or completion fluids. Third, the well data is only gathered when a problem is noticed in hydrocarbon production performance and corrective action is necessary. This type of well maintenance is clearly inferior to having a continuous monitoring system that anticipates and avoids a problem.

Therefore, there is a need for a method and apparatus for testing, completing and maintaining a well that minimizes time spent in testing hydrocarbon production and reservoir characteristics in the wellbore. Further, there is a need for a method and apparatus that minimizes formation damage while maximizing productivity of the well. Also, there is a need for methods and apparatus for testing of exploratory wells through existing wells that are faster and more economical than present methods.

SUMMARY OF THE INVENTION

The present invention is directed to an improved method and apparatus for testing, completing and monitoring a wellbore construction. The invention may be alternatively characterized as either (1) a data acquisition device capable of monitoring, recording wellbore and/or reservoir characteristics and including control of hydrocarbon production flow through a sensor device; or (2) a method of monitoring and/or recording at least one downhole characteristic during testing, completion, and/or maintenance of a wellbore.

When characterized as a data acquisition device, the present invention includes an assembly within a casing string comprising a sensor device or probe including an optional flow port allowing flow of hydrocarbons while having sand controlling ability. The present invention includes (1) at least one sensor device for sensing wellbore and/or reservoir characteristic, (2) a transmitting and controlling device located and carried in the casing string for transmitting data as the well is being tested, completed and/or maintained, and (3) an optional memory device located and carried in the sensor device and/or casing string for recording data pertaining to the monitored wellbore and/or reservoir characteristic including an information retrieving tool. The present invention has the capability of continuing to collect information and characterization of the wellbore and/or formation even when hydrocarbon flow is terminated or restricted by the sensor device.

The present invention comprises a data acquisition device containing a sensor linked to and/or containing a microprocessor device, and/or a recording device for retrieving at least one predefined wellbore or reservoir parameter or characteristic during wellbore testing, completion and/or production phases. Examples of downhole characteristics which may be monitored include: temperature, pressure, fluid flow rate and type, formation resistivity, cross-well and acoustic sesmometry, perforation depth, fluid characteristic or logging data. Further, with the addition of the microprocessor to the sensor device, the hydrocarbon production performance is enhanced by any number of downhole operations by activating localized operations in additional associated equipment, e.g., water shut-off operations at a particular zone, maintaining desired performance of a well by controlling flow in multiple wellbores, zone mapping on a cumulative basis, flow control operations, spacing casing and its associated flow ports in multiple zone wellbores, maintaining wellbore and/or reservoir pressure, sensing perforation characteristics, sensing reservoir characteristics or any number of other operations.

The present invention also includes the use of an optional permeable core or port located about the sensor device. The permeable core or filter media allows flow of hydrocarbons while preventing the flow of sand and other particulate matter. The permeable core comprises one or more of the following elements: brazed metal, sintered metal, rigid open cell foam, resin coated sand or a porous hydrophilic membrane.

Another related feature of the invention includes the use of a soluble compound surrounding the filter media which may be dissolved and/or removed at the option of the wellbore operator so that the filter media may be selectively opened to allow flow. Still another feature includes using a hydrophilic membrane in the sensor device that allows the flow of hydrocarbons, but not in-situ water.

Another feature of the invention is the use of a plurality of sensor devices in multiple zone wellbores allowing productive intervals to be selectively opened during remedial wellbore workover by dissolving a soluble compound coating the filter media or opening a valve or choke. Another feature of the invention includes the ability of extending the sensor device from a retracted position to an expanded position as desired by the wellbore operator.

Another feature of the invention is that of having the sensor device being positioned only on the outer diameter of the casing, rather than having it initially retracted in the casing and then extended outwardly. Another feature includes shaping the extendible tubular member so as to be embedded into the formation as it is being extended. All of these features are described in detail in the co-pending application of this invention, now U.S. patent application Ser. No. 08/388663 entitled "Method and Apparatus for Completing Wells," filed Feb. 14, 1995.

An improved method for wellbore testing, completion and maintenance is also disclosed herein. The method comprises positioning a casing string into a wellbore having a sensor device in communication with a target reservoir. The method includes correlating the position of the sensor device with the target reservoir so that the sensor device is adjacent the target reservoir. Then the sensor device is activated to test, complete and/or maintain a wellbore. The activation is accomplished through any number of methods discussed in the co-pending application, now U.S. patent application Ser. No. 08/388663 entitled "Method and Apparatus for Completing Wells," filed Feb. 14, 1995.

The improved method further comprises using the sensor linked to a microprocessor contained in the sensor device to evaluate, monitor, record and/or control any number of downhole operations previously described herein during either wellbore testing, completion or production phases. When using a memory device downhole, the stored data information may be retrieved by any number of methods. For instance, data may be retrieved when a well is being worked over. At this time, the well is easily accessible and therefore data retrieval equipment may be deployed to retrieve the data information from the memory device. Alternately, information from the surface may be sent downhole and stored in the memory device. Such information may relate to comparative data or control operations.

Information stored in the memory device is normally more useful if it is capable of being retrieved during periods when the wellbore is in operation. During these periods, the invention is equally accessible for data retrieval through a data retrieval mandrel. The data retrieval mandrel may be deployed downhole through the production tubing to retrieve the stored data information on the wellbore and/or fluid characteristics. The mandrel is designed to be aligned with the sensor devices and the attendant memory device. Once aligned, information may be transferred selectively as needed.

A method of testing an exploratory well to a target reservoir is also disclosed. The method comprises positioning a casing string in an existing well or an exploratory well and wherein the casing string contains sensing device to monitor any number of downhole operations during the exploratory phases of wellbore construction. The position of the sensor device is correlated so that the sensor device is adjacent the target reservoir and activating the sensor device provides data from the sensor which is in communication with the target reservoir. Testing the wellbore with the sensor includes monitoring any number of reservoir characteristics pertaining to a hydrocarbon zone and, if necessary, even allowing flow from the target reservoir.

In one wellbore embodiment, the method may be accomplished numerous times as described herewith. In such an embodiment, the exploratory well contains a lower, an intermediate, and an upper target reservoir. The method comprises positioning a casing string with possibly several sensor devices so that they correspond to depths of the lower, intermediate and upper target reservoirs. The testing of the wellbore containing the various hydrocarbon zones includes lowering a tubing string with a retrievable isolation packer for isolating the wellbore at a required zone; setting the isolation packer at a position above the lower target reservoir but below the intermediate target reservoir; and testing for any downhole characteristic of the lower target reservoir, including allowing flow from the formation, if necessary.

The method may further comprise shutting-in the well using data obtained through the sensor by placing a bridge plug in the well at a point above the lower target reservoir; repositioning the isolation packer to a point above the intermediate reservoir; then, setting the isolation packer, and testing and flowing the well, from the intermediate reservoir and so forth with any number of target zones or reservoirs.

A substantial advantage of the present invention includes obtaining data rapidly thereby greatly improving the efficiency and accuracy of wellbore testing and/or maintenance. Depending on the configuration of the sensor device, real time data is available to the well operator during exploratory testing, during completion and during production of a wellbore. It is clear to those skilled in the art as to the value of such information as it allows for substantial savings in wellbore trips, operations, and safety.

Another advantage includes being able to test an exploratory well by custom designing the casing string after reviewing downhole logs which provide the position of the hydrocarbon zones, and thereafter testing the zones individually.

Another significant advantage of the present invention allows for minimizing the time for wellbore completion because of the data available through the sensor device. When completion operations are monitored, it is likely that the wellbore will operate to full capacity and enhanced recovery of hydrocarbon from the reservoir due to data verification of wellbore as it is being completed. Further, significantly less time is expended completing a wellbore construction with such data and therefore having the additional advantage that formation damage is prevented due to drilling and completion fluids stagnating in the wellbore.

Another advantage includes providing substantial cost savings by using less completion equipment.

Another advantage includes use of a filter media comprising a metal core which is highly porous, permeable, and that which has very high compressive strength values ensuring that the sensor will retain its integrity during any number of operations.

Similarly, it becomes clear the many significant advantages obtained from having a sensor in close proximity to the target zone in maintaining wellbore production. The close proximity allows for immediate and critical data useful in maintaining maximum production from a wellbore. Similarly, recorded data may be very useful during workover operations giving the well operator detailed history of the wellbore condition during production.

Additional objects, features and advantages will become apparent in the detailed description which follows.

DETAILED DESCRIPTION OF THE INVENTION

1. Overview of wellbore testing, completion and production methods

Figure 1:
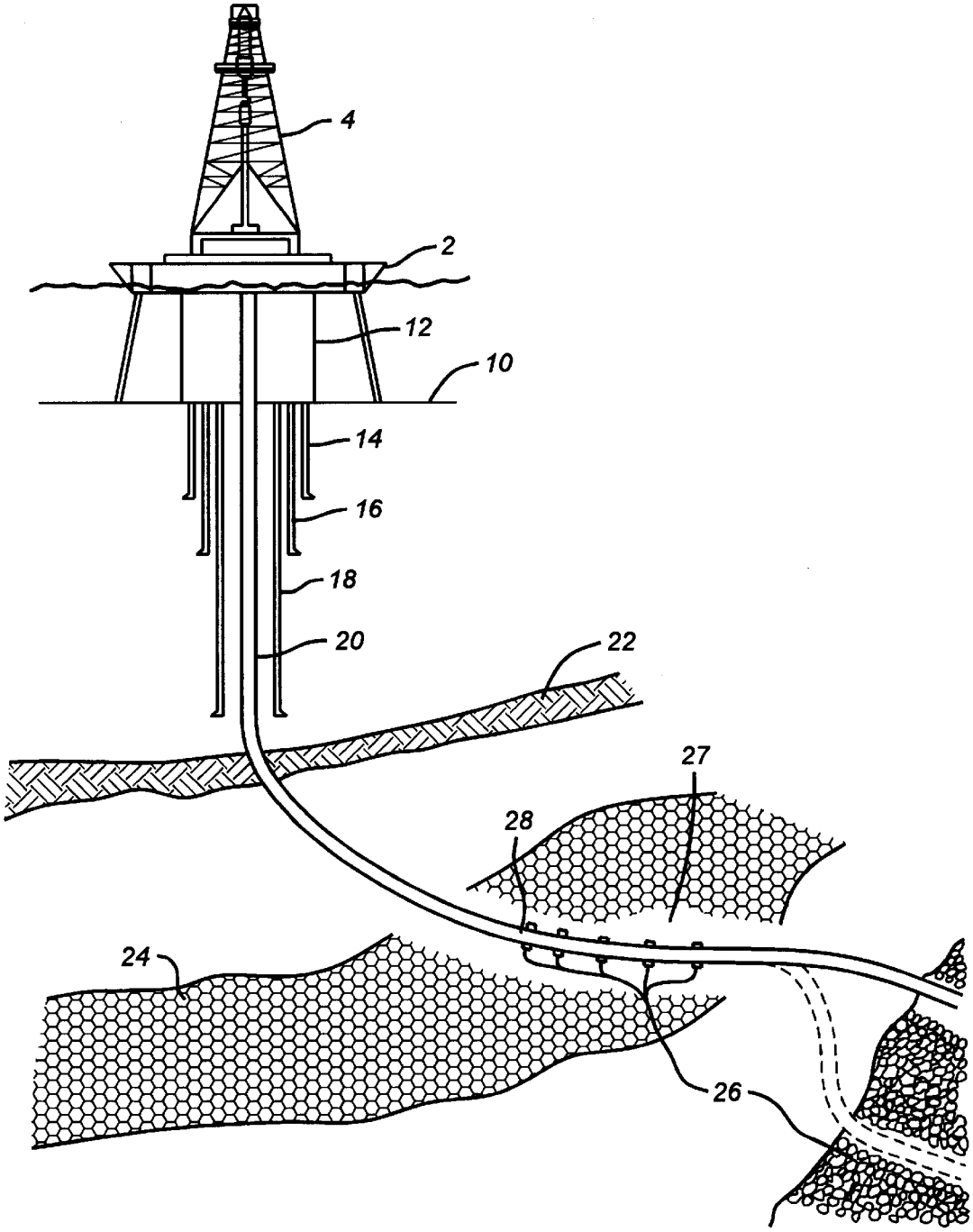
FIG. 1 is an illustration of a drilling rig on a drilling platform having a wellbore section that intersects multiple subterranean reservoirs (partially shown).
Figure 2:
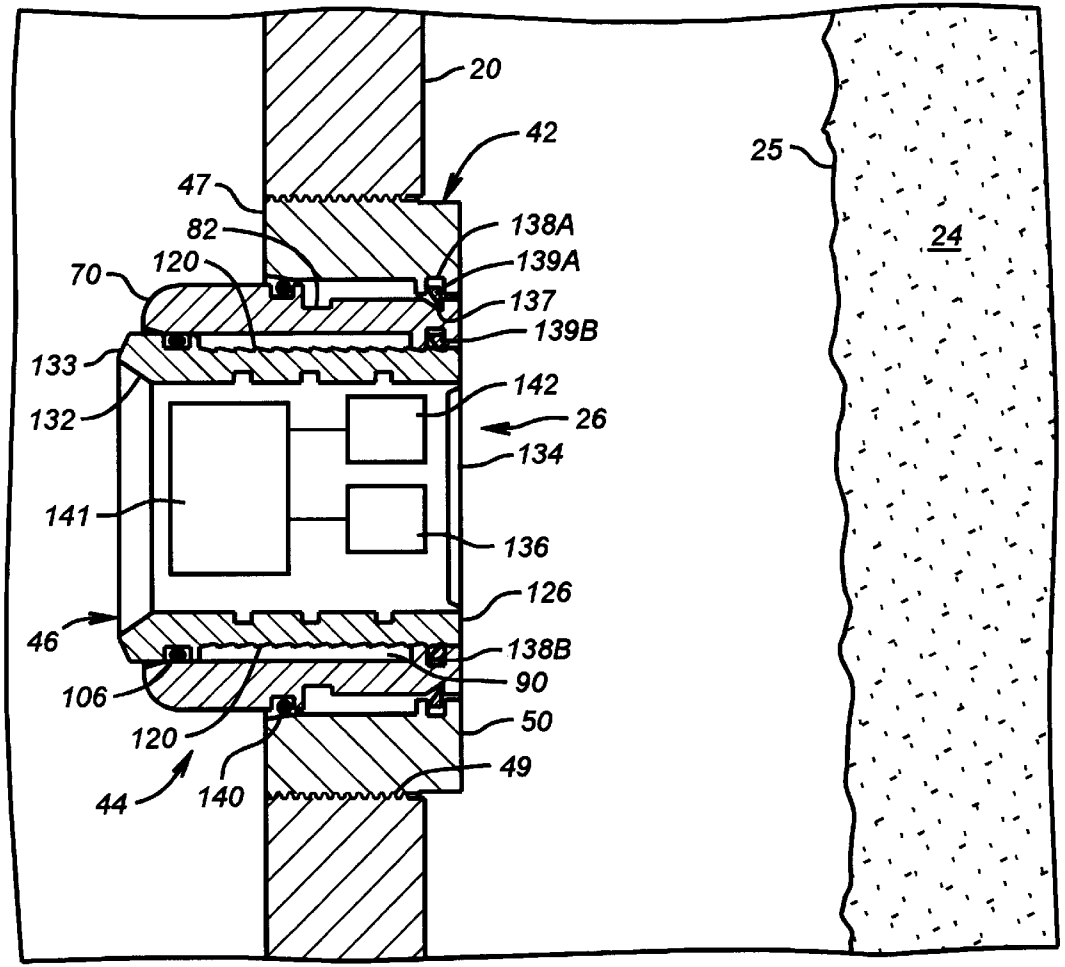
FIG. 2 is a cross-sectional view of the extendible member with the sensor device and microprocessor before engaging the wellbore wall.

This invention relates to a method and an apparatus for testing exploratory wellbores, completion of wellbores and controlling production in a wellbore through the use of an improved sensor device containing a sensor 136 (as seen in FIG. 2). In particular, in an embodiment of the present invention, an improved testing, monitoring and controlling sensor device 26 is described for testing, monitoring and controlling a wellbore zone from a remote location, as for example, a conventional semi-submersible drilling vessel 2 depicted in FIG. 1 or such other surface location, or in the alternative from a downhole location 28 in a closed loop operation as will be apparent in the description provided herewith. A general description of the electronic sensing, communication and controlling system is provided herein while details will be incorporated in later pages.

Referring now to FIG. 1, a conventional semi-submersible drilling vessel 2 is depicted showing a drilling rig 4. The wellbore casing strings include the conductor, surface, and intermediate strings 14, 16, and 18, respectively. As is well understood by those of ordinary skill in the art, the casing string intersects various subterranean reservoirs 22, some of which may contain hydrocarbons. As is shown in FIG. 1, the target reservoir 24 has the production string 20 positioned adjacent thereto, in an open hole completion 27. It should be clear to a person skilled in the art that a wellbore completion may include a casing string 18 extending to the target reservoir 24 along with the production string 20. In such a wellbore completion, the sensor device may be located on the casing string 18.

The production string 20 contains a plurality of sensor devices 26 for monitoring subterranean characteristics of multiple locations. Optionally, the sensor devices 26 also control reservoir sand production while allowing flow of hydrocarbons. However, it should be clear that only a single sensor device 26 is necessary for the present invention to function adequately. The sensor devices 26 are mounted within openings contained in the production string 20 wall.

2. Construction of the sensor device containing a sensor

Referring to FIG. 2, an cross-section view of the preferred embodiment is shown. The sensor device 26 comprises a housing 42, a first sleeve 44 and a second sleeve 46. The housing 42, on its outer diameter surface 48, is provided with an external thread 49 for mounting the housing 42 to the casing string 20 with a matching thread 49. Mounting the sensor device 26 with a threaded method will effectively seal the housing 42 threaded in the opening in the wall of casing string 20. It should be noted that any number of alternative means are available for sealingly mounting the housing 42 to a casing or production string. A groove 138A in the housing 42 is provided for the placement of a detent 139A for preventing backward movement of the first sleeve 44 is provided once it is extended outwardly. In the preferred embodiment, the detent 139A comprises a snap-ring operatively associated with the first sleeve 44.

The first sleeve 44 generally comprises a tubular member with a curved surface 70 at one end which cooperates with a wiper plug tool (not shown) to activate and extend the first sleeve 44 outwardly towards the wellbore wall. The first sleeve 44 is moveably mounted within housing 42 with a sealing member such as an "O-Ring" 140.

The second sleeve 46, which serves as the container for the sensor 136 and/or optionally including a filter media 135, will now be described. The second sleeve generally comprises a tubular member with an outer surface having a radial groove for placement of a sealing member 106 such as an "O-Ring" to sealingly engage the first and second sleeves, 44 and 46, respectively. The outer surface of the second sleeve 46 also presents thereon a plurality of ratchet grooves 120 for operative association with a detent 139B located between the first and second sleeves 44 and 46 respectively, thereby preventing backward movement of the second sleeve 46. The second sleeve 46 has sufficient space to insert a sensor 136, a microprocessor 141 (not shown) or in the alternative, a memory device (not shown). Examples of sensors now available include Miniaturized Optimized Smart Sensors (MOSS) available from Southwest Research Institute in San Antonio, Tex. Along with the MOSS technology, high voltage power supplies used for detector bias voltages that generate potentials up to 4 kilowatts, weighing only 30 grams, and use only 80 milliwatts of power. In addition, modem sensors are now built to withstand high temperatures and pressures, thus well suited for downhole wellbore environments.

When including a filter media 135 in the sensor device 26, to allow hydrocarbon flow, a soluble disc 134 is mounted at the outer end of the second sleeve 46 (towards the wellbore wall 25), such that a container is formed for the placement of a filter media 135 comprising a porous core. The core also contains a sensor 136 for sensing a wellbore characteristic or parameter. An internal cap member (not shown) or a barrier coating may also be applied at the opposite surface end of the filter media 135 (towards the interior of the casing string 20) to maintain the integrity of the filter media 135 and the sensor 136 when hydraulic pressure is applied from inside the casing string 20. The cap is designed to "pop off" at a pre-determined pressure level. In the alternative, a barrier material may be coated along the interior surface of the filter media 135 and which may be dissolved at a later time allowing fluid communication there through.

It should be noted that the second sleeve 46 is provided with a chamfered surface contoured such that a spherical ball (not shown) of an appropriate diameter may be set in the seat profile 132 at the interior edge of the second sleeve 46. The spherical ball will seat and seal the sensor device when the pressure is greater on the inside of the casing string 20 than at the outside of the casing string 20.

In the embodiment having a porous core acting as the filter media 135, the sensor device 26 comprises generally a sleeve 46 having a plurality of stainless steel metal beads that are bonded thereto with a powder consisting of phosphorous, chromium, iron, and nickel surrounding the sensor 136. The brazing powder (not shown) is referred to as a BNi-7 compound and in one embodiment comprises of approximately 4% phosphorous, 17% chromium, 1% iron and 79% nickel. In another embodiment, the brazing powder may contain at least 1% phosphorous, at least 10% chromium, at least 0.5% iron and at least 60% nickel.

A brazing process is utilized to manufacture the filter media 135 in the sleeve 46. In other embodiments, the beads could be selected from a group consisting of chromium, ceramic, silica, titanium, and/or copper. The filter media 135 made from this brazing process results in a core that is very porous and highly permeable. Also, the core exhibits significant compressive strength, an important factor for deployment since the sleeve will undergo significant tensile and compressive forces at that time.

The beads are sized to optimize sand control performance. In other words, the beads should be sized to prevent formation sand migration into the internal diameter of casing 20, but also allow for the maximum porosity and permeability of the core 135 so that production of the reservoir fluids and gas is maximized.

3. The sensor device

Figure 4:
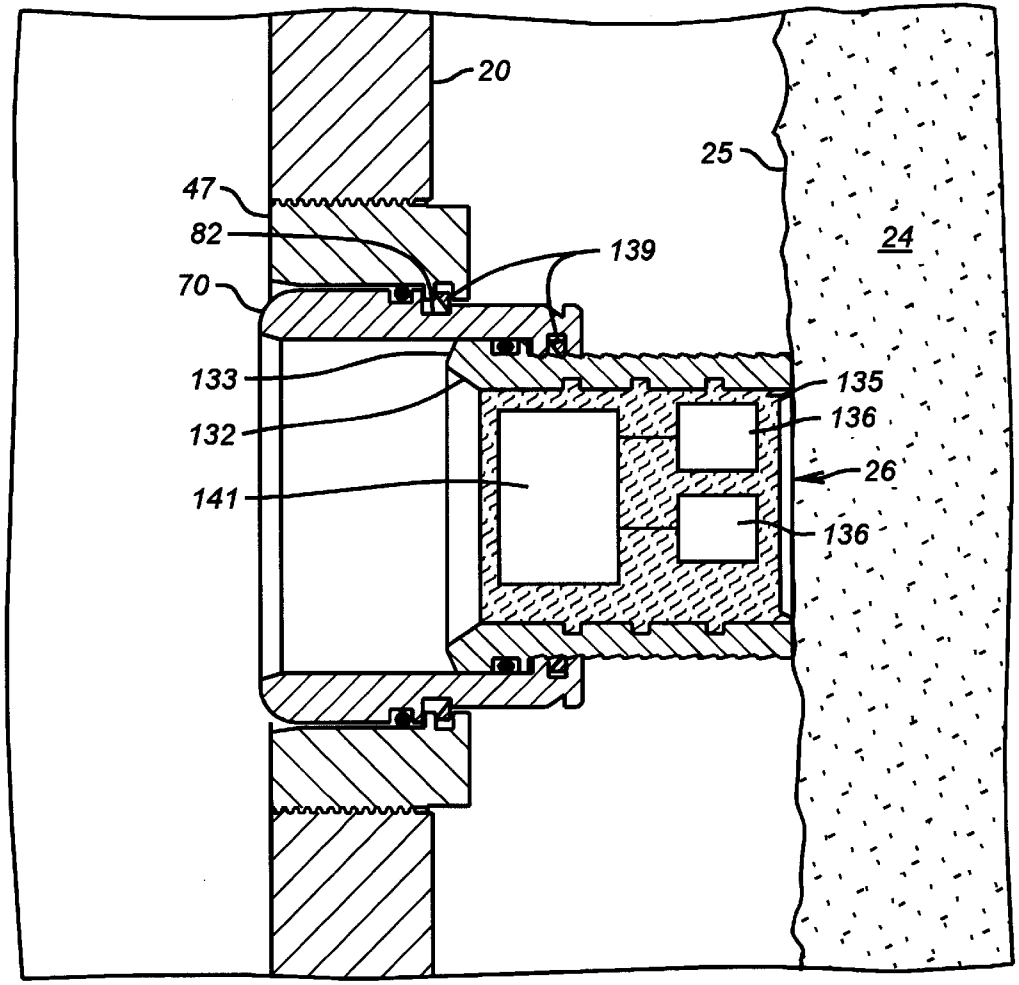
FIG. 4 is a cross-sectional view of the sensor device as seen in FIG. 2 after being extended into contact with the formation.
Figure 5:
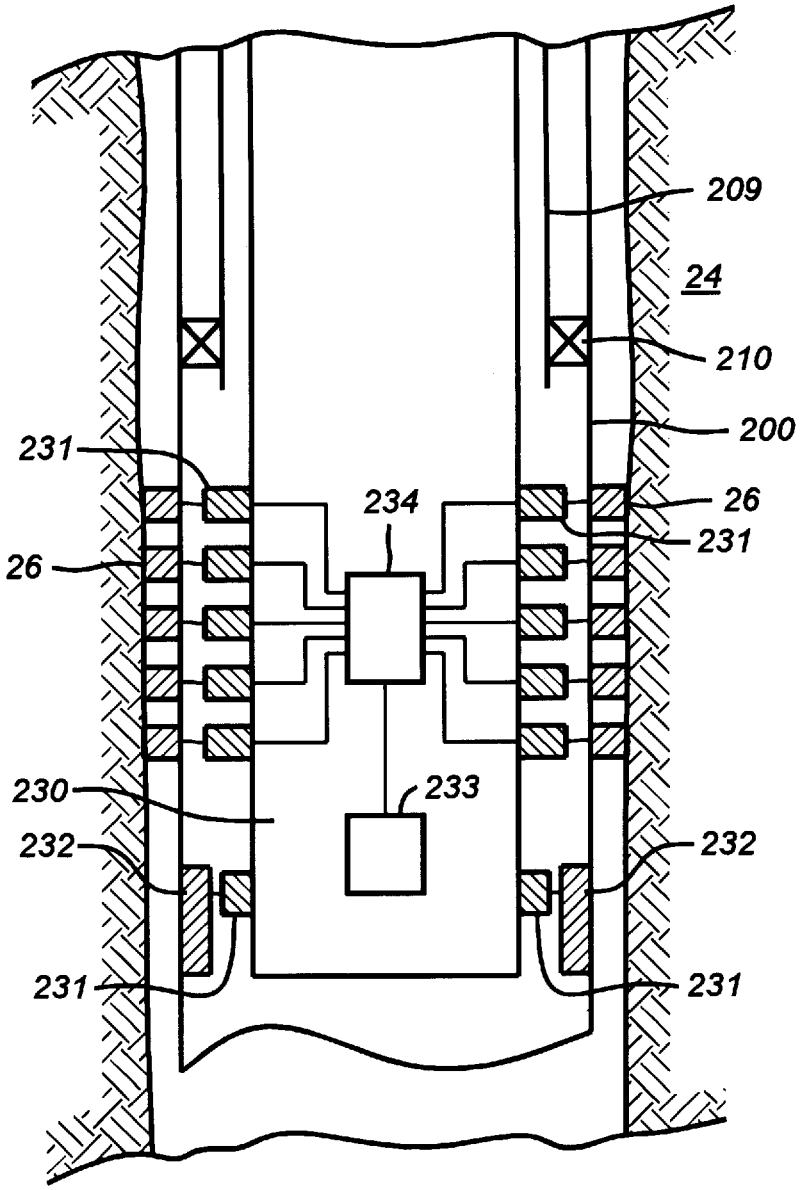
FIG. 5 is a cross-sectional view of a memory retrieval mandrel in alignment with the sensor devices and the memory devices in a well test string.

As seen in FIGS. 2 and 4, the sensor device 136 may be of any type depending on the desired function to be accomplished. Common parameters required for downhole operations include, but not limited to, monitoring wellbore temperature, pressure, fluid flow rate and type, formation resistivity, cross-well and acoustic sesmometry, perforation depth, fluid characteristic or logging data. With the addition of a sensor 136 to the sensor device 26, and a microprocessor 141 provided for analyses, and a control module for performing an operation downhole, the reservoir performance may be greatly enhanced by providing instructions to other equipment located downhole to perform certain tasks or functions. For example, flow of hydrocarbon production may be adjusted in a particular zone to increase production in another zone. Another example includes finding the best route for a subsequently constructed branch wellbore. In such a situation, a wellbore has been under production for sometime and is about to deplete a certain zone. In such cases, reservoir data gathered over a period of time is very useful in pinpointing the location of a new branch wellbore to another zone or reservoir. The adjacent reservoir is most efficiently accessed through the original wellbore by determining well characteristics and drilling a branch wellbore from the existing wellbore for accessing the new hydrocarbon reservoir.

One or more sensors 136 may be placed in the sensor device 26 depending on the operator's needs and the type of data required for a particular well being exploited. In some cases, one sensor may be sufficient to measure several characteristics, and in other cases, several sensors may be necessary to take adequate readings. In other cases, flow may be necessary. However, it must be noted that flow characteristics may diminish with increasing number of sensors in a single sensor device 26. In order maximize efficiency in the placement of sensors, a plurality of sensor devices 26 may be provided containing disparate sensors as needed. Examples of sensors depending on the parameter to be sensed include: acoustic sensors, seismic sensors, strain and stress gages, transducer, or any other sensor. A sensor herein is broadly defined as an information pick-up or data retrieval device. It is a component the may convert chemical, mechanical or heat energy into an electrical signal either by generating the signal or by controlling an external electrical source. It may be a transducer designed to produce an electrical output proportional to some time-varying quantity or quality as temperature, pressure, flow rate, fluid characteristic, formation characteristic and so forth. As previously discussed, the level of sophistication of available sensors only increases each day, i.e., MOSS sensors are only the latest in a line of sophisticated sensors available today.

4. Utilization of the invention in wellbore testing, completion and production operations Any number of downhole operations may be performed which are associated with well testing, well completion procedures and/or maintaining well production by monitoring and/or activating localized operations. For example, the following functions may be performed: (1) water shut-off operations at a particular zone; (2) maintaining desired performance of a well by monitoring wellbore parameters such as pressure, temperature, flow rate or any other similar characteristic; (3) initial zone mapping on a cumulative basis using data sensed along the wellbore length during well testing operations; (4) performing flow control operations among various zones after sensing various wellbore parameters; (5) performing completion operations such as spacing the casing string and its associated perforations to provide the most efficient placement of flow ports in a multiple zone wellbore with the sensed data of any characteristic; (6) sensing perforation characteristics during completion operations to maximize hydrocarbon production; (7) sensing any number of reservoir characteristics during an initial testing phase of a wellbore; and/or (8) any number of other operations during the testing, completion and production phases of a wellbore.

5. Electronic communication methods and apparatus

The testing, monitoring and controlling of a wellbore target zone 24 may be accomplished by the wellbore operator from the surface 2 when the sensor device 26 is associated with a communication system allowing transmission of sensed data between the downhole location 28 of the sensor device 26 to the surface location 2 and vice versa. The monitoring and/or controlling system of this sensor device comprises a surface control system or module comprising central processing unit (not shown) and one or more downhole monitoring and/or control systems located near a target zone 24 in a wellbore. The downhole monitoring system comprises a sensor device 26 containing at least one sensor. A downhole controller system is provided in addition thereto for performing a required task in response to a signal transmitted from the surface 2 by the wellbore operator through the central processing unit.

In an alternate operation, a completion string 20 may be equipped with a central processing unit (microprocessor 141) at a downhole location 28 near the sensor device 26 for a closed loop operation. In this case, a sensed wellbore parameter signal is received from the sensor 136 and transmitted to a microprocessor 141. The microprocessor 141 then uses the relayed signal to execute pre-programmed instructions in response to the received signal. An appropriate instruction signal is then forwarded to a downhole control system located in the wellbore to perform a required function. In accordance with a preferred embodiment of the present invention, the downhole monitoring and/or controlling system comprises of at least one downhole sensor, a downhole microprocessor 141 and at least one downhole electromechanical control module which may be placed at different locations in the wellbore to perform a given task. Each downhole monitoring and/or controlling system has a unique electronic address. Further, the microprocessor may be asked to verify its analysis with a wellbore operator at the surface.

The electronic communication and control methods and apparatus are discussed and explained in great detail in the applicant's pending applications: (1) U.S. patent application Ser. No. 08/385,992, entitled "Downhole production well control system and method" filed Feb. 09, 1995; (2) U.S. patent application Ser. No. 08/390,322, entitled "Method and apparatus and recording of operating conditions of a downhole drill bit during drilling operations" filed Feb. 16, 1995; (3) U.S. Provisional patent application Ser. No. 60/002,895, entitled "Method and apparatus for enhanced utilization of electrical submersible pumps in the completion and production of wellbores" filed Aug. 30, 1995. All of the contents of these applications are hereby incorporated by reference.

It is apparent from these applications that the communication methods could be through microwave, electromagnetic, acoustic, NMR or even hardwired technologies. It should be apparent to those skilled in the art that the novelty of the present invention does not lie in the electronic communication method, by itself, used between a downhole location and a surface location, or in the alternative, a communication method in a localized downhole area. Instead, the novelty lies, at least in part, in the use of sensor devices for performing specific functions during wellbore production and/or exploratory phases. The sensor devices may exist in a predetermined symmetry intermittently or continuous depending on the wellbore characteristics culminating in a novel and efficient techniques in wellbore testing, completion and production which heretofore were not available resulting in many disadvantages described previously. The present invention provides many advantages over the prior art testing, completion and production techniques as described herein previously. The novelty further lies in the ability of a wellbore operator to maximize efficient hydrocarbon production by eliminating many aspects of wellbore testing and completion methods to thereby greatly reduce costs for the operator.

6. Alternative embodiments

As can be seen in FIG. 2, the housing 42, with the first sleeve 44 and second sleeve 46 are telescoped so that the sensor device 26 is in a retracted position. It should be noted that it is not necessary to have the sensor device 26 comprising three tubular members as described herein. Such an embodiment is only described herein as the preferred embodiment. The sensor device 26 may function equally with a single tubular member mounted in a threaded fashion or by other means on the casing string 20 containing a sensor 136, a microprocessor 141, and a transmitter (not shown) without departing from the spirit of this invention. It is clear to one skilled in the art that various methods and designs may be undertaken for mounting probes containing sensors on casing strings—whether they be retractable, simply surface mounted flush against the tubing wall, or one-time extending probes.

In the alternative, the sensor device may be operatively associated with an adjustable choke or a valve (ball) or a flapper or a "Drill-Stem Testing" valve. For example, the sensor device 26 in the adjustable choke or ball valve may be activated upon mechanical or pressure sensitive control or activation systems. Many examples of these type of conventional valves are available from Baker Oil Tools, a company employing the applicant. The design of the probe is not critical to the operation of this invention.

7. Sensor device performing sensor operations

The downhole control systems 150 will interface with the surface system using wireless communication or alternatively through an electrical wire (i.e., hardwired) connection or any one of the previously described methods. The downhole systems in the wellbore can transmit and receive data and/or commands to or from the surface and/or to or from other devices in the wellbore. The downhole controller acquires and processes data sent from the surface as received from a transceiver system and also transmits downhole sensor information as received from the data acquisition system comprising the sensor devices 26 and/or memory device 232 and/or microprocessor 141 and also transmits downhole sensor information as received from the wellbore.

Figure 3:
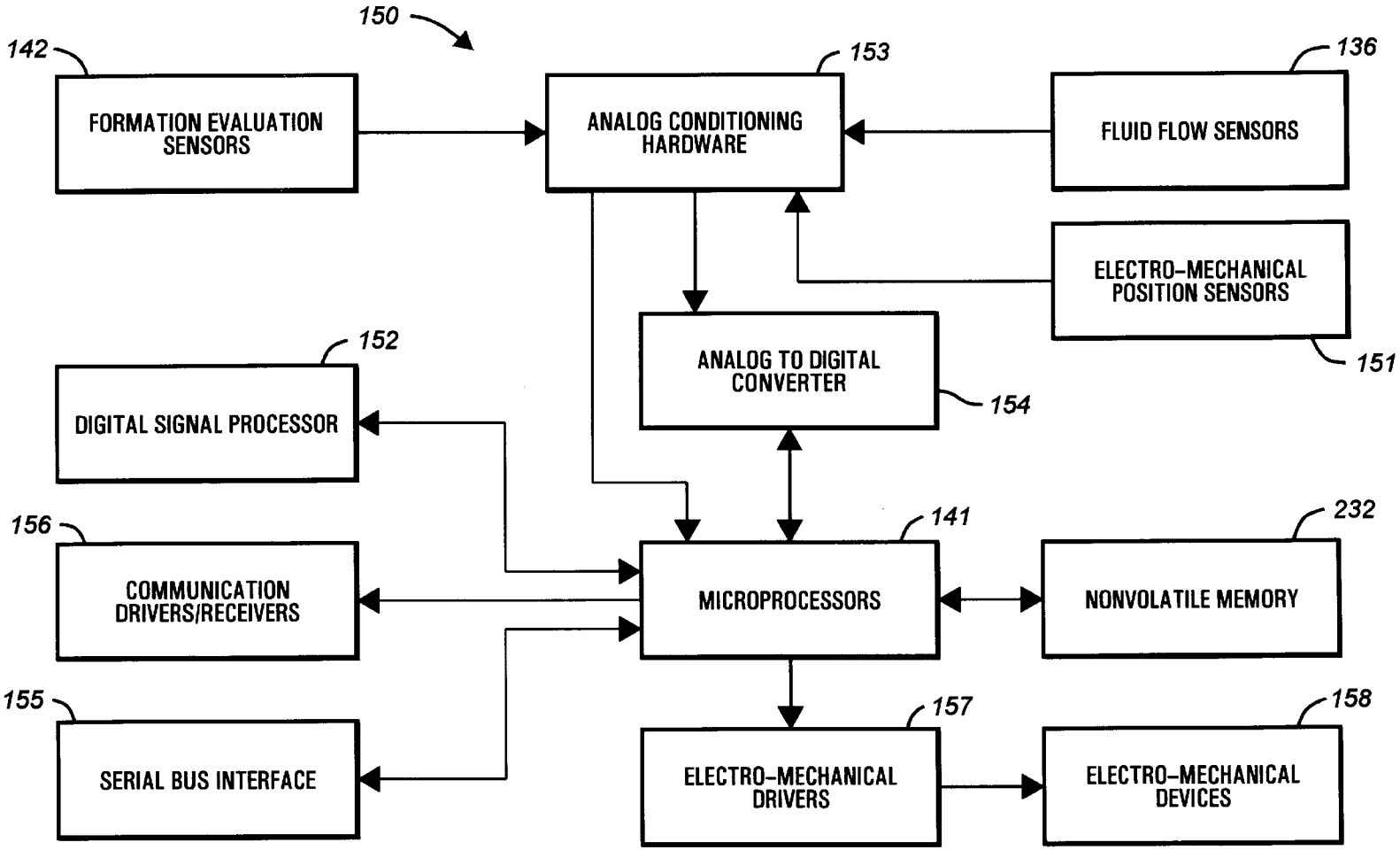
FIG. 3 is an electrical schematic of the sensor device connected to the microprocessor and downhole control systems.

Referring now to FIG. 3, an electrical schematic of a downhole controller 150 is shown. The data acquisition system will preprocess the analog and digital sensor data by sampling the data periodically and formatting it for transfer to the microprocessor 141. Included among this data is data from flow sensors 136, formation evaluation sensors 142, and/or electromechanical position sensors 151. The electromechanical position sensors 151 indicate the position, orientation and the like for the downhole tools and equipment.

The formation evaluation data is processed for the determination of the reservoir parameters related to the well production zone being monitored by the downhole controller 150 and/or tested in the case of an exploratory well. In addition, data may be readily obtained as to reservoir conditions to map alternative branch wellbores. Also, sensors will pick-up information on reservoir content and depletion rates.

The flow sensor data may be processed and evaluated against parameters stored in the downhole module's memory to determine if a condition exists which requires the intervention of the processor electronics 141 to automatically control the electromechanical devices 156. The downhole sensors may include, but not limited to, sensors for sensing pressure, flow, temperature, oil/water content, geological formation characteristics, gamma ray detectors and formation evaluation sensors which utilize acoustic, nuclear, resistivity and electromagnetic technology.

The downhole controller 150 may automatically execute instructions for actuating electromechanical drivers 157 or other electronic devices for controlling downhole tools such as a sliding sleeve valve, shut-off device, valve, variable choke, penetrator, perf valve or a gas lift tool.

In addition, the downhole controller 150 is capable of recording downhole data acquired by flow sensors 136, formation evaluation sensors 142 and the electromechanical position sensors 151 in the memory device 232. The microprocessor 141 provides the control and processing capabilities of the system downhole. The processor will control the data acquisition, the data processing, and the evaluation of the data for determination if it is within the proper operating ranges. The controller 151 will also prepare the data for transmission to the surface, and drive the transmitter to send the information to the surface. The processor 141 also has the responsibility of controlling the electromechanical devices.

The analog to digital converter 154 transforms the data from the conditioner circuitry in a binary number. That binary number relates to an electrical current or voltage value used to designate a physical parameter acquired from the geological formation, the fluid flow, or the status of the electromechanical devices. The analog condition hardware 153 processes the signals from the sensors into voltage values that are at the range required by the analog to digital converter. The digital signal processor 152 provides the capability of exchanging data with the processor to support the evaluation of the acquired downhole information, as well as, to encode/decode data for the transmitter (not shown). The processor 141 also provides the control timing for the drivers 156. The communication drivers 156 are electronic switches used to control the flow of electromechanical power to the transmitter. The processor 141 provides the control and timing for the drivers 156. The serial bus interface 155 allows the processor 141 to interact with the surface acquisition and control system (not shown). The serial bus allows the surface system to transfer codes and set parameters to the downhole controller to excecute its functions.

Placement of the microprocessor 141, whether it be in the sensor device 26 itself or in the alternative, at a nearby location in the casing string is dependent on the complexity of operations to be conducted downhole. In an operation involving, closed loop operations, a Miniaturized Optimized Processor for Space—RAD6000 or MOPS6000 is available from the Southwest Research Institute. The RAD6000 is an ultra compact computer, approximately, 300 cubic centimeters in size with 350 grams in weight, and capable of delivering 25 million instructions per second. Thus, a single microprocessor 141 optimally located in the casing string could feed instructions for all of the plurality of sensors mounted on the casing string. The location itself could be in one of the sensor devices 26 or in the alternative along a portion of the casing. The sensors 26, in turn, may be located in a predefined symmetry along the casing string and linked to the microprocessor 141. Instructions are then issued to electromechanical devices 158 located nearby or at a distance from the microprocessor 141. These electromechanical control devices manipulate various conditions of wellbore performance. In addition, all uses presently provided by wireline operations may be conducted by existing sensors already in place along the casing string.

In addition, a Space Adaptable Memory module (SpAMM), also available from the Southwest Research Institute, is ideal for downhole operations by providing dense, scalable, nonvolatile gigabyte mass memory in a small light weight package. High-density multi-chip modules and staked memory dies are used in SpAMM to deliver a memory density of 84 megabytes per cubic inch.

Thus, certain data may be gathered and stored while other data used immediately for operations. It becomes clear to one skilled in the art that permutations of data to be used will depend on a myriad of operations to be performed. Well logging may be well suited for the memory device 232 while temperature, pressure and flow characteristics are more adapted to be used immediately to control wellbore performance. The memory device 232 is better suited for exploratory well data used during drilling operations of subsequent branch wellbores. The information gathered itself could be a myriad of possibilities. For example, data could relate to the wellbore itself, other nearby wellbores, single or multiple reservoirs, multiple zones in a single reservoir or cross-well information relating to all of the above.

When using a memory device 232 downhole, the stored data information may be retrieved by any number of methods. For instance, data may be retrieved when a well is being worked over. At this time, the well is easily accessible and therefore data retrieval equipment may be deployed to retrieve the data information from the memory device 232. However, information stored in the memory device 232 is normally more useful if it is capable of being retrieved during periods when the wellbore is in operation. During these periods, the invention is equally accessible for data retrieval through using real time communication methods to transfer data from a downhole location to the surface or to transfer it to a microprocessor 141 for processing and then to a control system.

During other times, a data retrieval mandrel 230 may be deployed downhole through the production tubing 209 to retrieve the stored data information on the wellbore and/or fluid characteristics. Referring to FIG. 3, the mandrel 230 is designed to be aligned with the sensor devices 26 and the attendant memory device 232. The mandrel 230 is equipped with an information pick-up device 231 which are aligned either with the sensors 26 or the memory device 232. Once aligned, the information may be transferred selectively as needed. Alternatively, a memory device 233 may be located in the mandrel 230 which collects the data directly from the sensor devices 26. The memory device 233, if necessary, could also store information collected from the downhole memory device 232 but the preferred method is to transmit data to the surface directly. Also a microprocessor 234 located within the mandrel 230 may selectively perform required action while located downhole.

8. Extending the Sensor Device to the Wellbore Wall:

In performing wellbore operations, activation of the sensor device to extend to the wellbore wall may be accomplished by any number of methods. For example, the sensor device may be activated (extended) by electronic methods, mechanical methods or in the alternative through the use of hydrostatic pressure. Existing technology has offered either of the latter options. For example, mechanical activation is achieved through a mechanical activation member which may be a wiper plug (not shown). The wiper plug is lowered down into the casing string 18 until the wiper plug contacts the first sleeve 44 which will cause both the first sleeve 44 and second sleeve 46 to move from a retracted position to an intermediate position locking it from backward movement, as well as, locking the first sleeve 44 in an extended position. The wiper plug is pumped down using conventional techniques such as those used during cementing operations. The sensor may be utilized during any portion of this mechanical activation to obtain any number of wellbore characteristics. Use of downhole data during various operations is only limited by the users creativity and needs.

Hydraulic pressure is then applied to the internal diameter of the casing string 20. The hydraulic pressure applied on the sensor device forces the second sleeve 46 to extend outwardly towards the formation wall 25 as seen in FIG. 4. The second sleeve 46 will proceed outwardly until either the outer end of the sensor device 26 surface contacts the formation wall 25 or until all ratchet pawls have fully extended past the detent 139B. Again, use of the sensor 136 to obtain any data during any portion of the operation is possible. The parameter or data obtained is only limited by the needs of an operator.

The entire sensor device 26, including the first 44 and second sleeve 46, may be also extended by purely hydraulic means in the event that the mechanical means is not practical or undesirable. In such a case, the wellbore operator would pump down the casing string a composition that coats the sensor device 26 when designed to allow flow through a filter media 135, or alternatively, a soluble/impermeable compound may be placed on the filter media 135 at its interior surface. The composition used to form an impermeable barrier is of a type conventionally available from Baker Hughes Incorporated under the trademark PERFFLOW™. The internal casing string pressure forms a filter cake from the composition, such as PERFFLOW™, on the core surface of the filter media. The hydraulic pressure acting against the impermeable barrier and the core surface of the filter media deploys the first and second sleeves as described previously.

As previously discussed, sensor data may be utilized in any number of ways depending on the needs of the operator. For example, flow characteristic may be an important criterion during the coating operation to maximize efficiency. A flow sensor would provide data to the operator as to when a particular sensor device is completely coated so as to stop transmitting the coating compound.

Similarly for certain acidizing operations, a sensor 136 in the sensor device 26 may provide ideal data for conducting efficient and time-saving operations. During acidizing operations, the a spherical ball (not shown) is provided in the seat profile 132, as seen in FIG. 4, for sealing engagement with the sensor device 26 preventing flow. If it is determined that a sensor device 26 requires acidizing operations because of poor hydrocarbon flow characteristics as detected by the sensor 136, then it may be necessary to send a diverting ball downhole which seeks out the seat profile in the sensor device 26 having a low pressure drop across it. Acid is then pumped down the casing string 20. The acid is diverted away from a sensor device having high pressure drop across it (indicating good flow condition) because the diverting ball seals the sensor device 26 along the seat profile 132. The diverting ball by-passes a sensor device having a low pressure drop because the hydraulic pressure is great enough to sustain a downward movement of the diverting ball. Increasing the internal pressure of the casing string 20 causes the diverting ball to seal against the chamfered surface 132.

Conventional ball injector systems are commonly available in the oilfield industry. This technique may be utilized throughout the life of a wellbore, especially when it is necessary to perform remedial acidizing and/or fracture stimulation of a wellbore to maintain maximum hydrocarbon production. In all of these operations, the sensors 136 may be used in creative ways to monitor any wellbore parameter during any portion of the procedure. The use of the sensor 136 to utilize data for a particular condition is only limited by the user's creativity.

Figure 6:
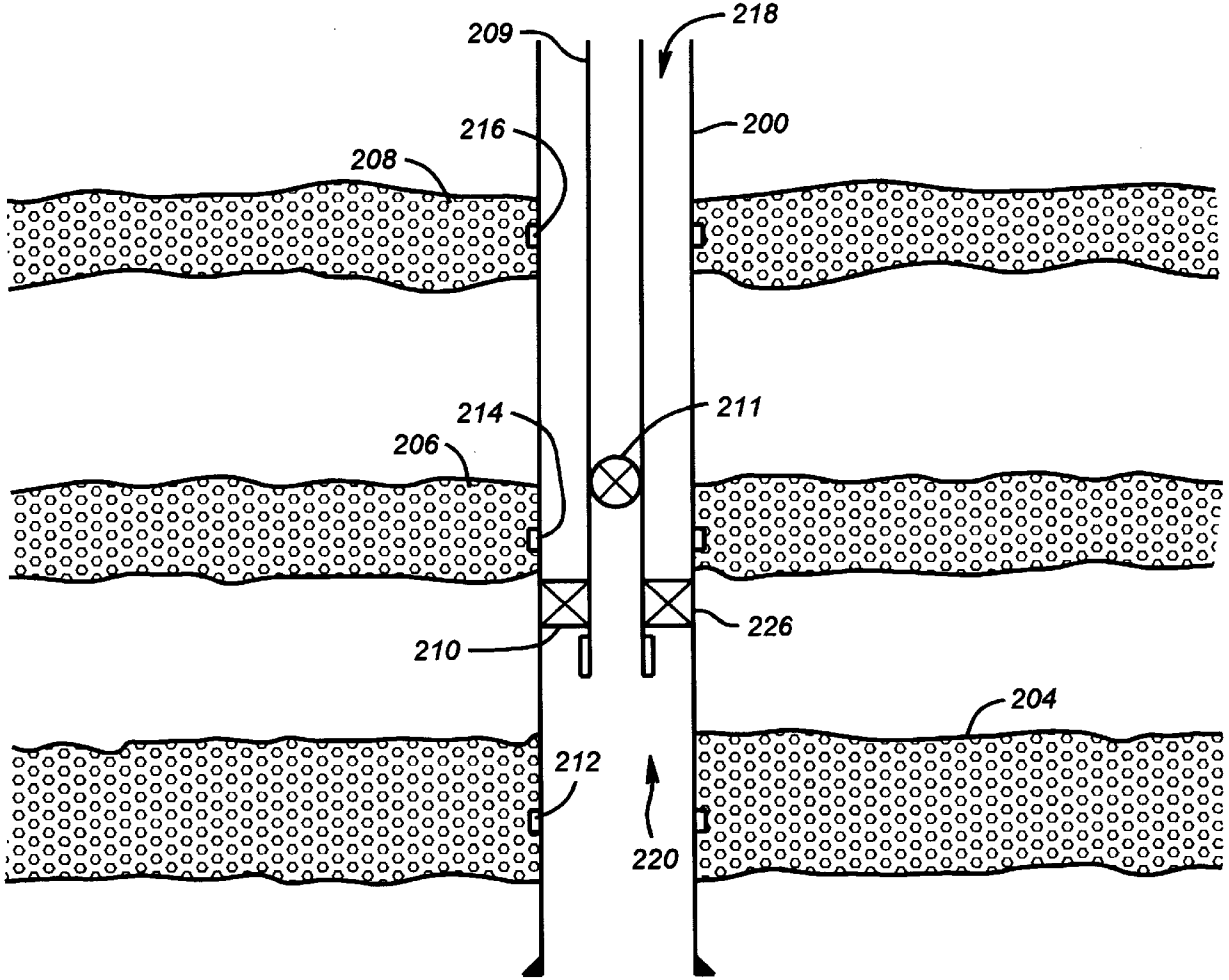
FIG. 6 is a cross-sectional view of a well test string schematic shown testing a lower formation.

9. Multiple Zone Testing:

Referring now to FIG. 6, the method of testing an exploratory well will now be described in a multi-zone testing operation. Again, in this type of an operation, the sensor 136 located in the sensor device 212 provides ideal opportunity for the retrieval of necessary data to maximize efficiency during exploratory operations while eliminating certain unnecessary prior art procedures. A particular advantage provided by the sensor in the sensor device is the provision of "real time" data during exploratory phases in wellbore operations. This "real time" data may be utilized in performing any number of operations during the exploratory phase. In the alternative, localized closed loop operations may be also be performed depending on the needs of the operator after detection of the pre-determined request for data is satisfied and analyzed by a local microprocessor 141.

The method includes first positioning in the exploratory well a casing string 200. The casing string 200 intersects a series of target reservoirs 204, 206, 208 respectively. A testing work-string 209 is also run into the well which includes a packer member 210 that is capable of multiple setting along the wellbore length. The testing work-string 209 will also contain a valve member 211 capable of movement from an open position to a closed positioned within the work-string 209.

The position of the bottom-hole assembly 202 is then correlated as the work-string 209 is run into the casing string 200 in the wellbore so that the bottom-hole assembly 202 is adjacent a lower-most target reservoir 204. In the preferred embodiment, open-hole logs are first recorded, and therefore, the location of a test hydrocarbon zone will be known. Thus, casing string 200 containing multiple sensor devices may be positioned at the appropriate depths adjacent each hydrocarbon production zone through selectively using the sensor 136 in each sensor device 212, 214, 216, respectively. Thus, using the sensor 136, each sensor device may be activated at localized production zones, thus efficiently completing the wellbore construction without the necessity of multiple trips into the wellbore. This type of a wellbore completion maximizes hydrocarbon production from the wellbore while preventing sand production. A plurality of sensor devices may be provided for each isolated zone which are spaced about the circumference of the casing string 200. Spacing the sensor devices axially along the casing string 200 as needed further maximizes zone identification and positioning.

A packer member 210 seals the inner diameter of the work-string 209 from the lower end of the casing string 200 thereby forming an upper annulus 218. In the example depicted, the lowest sensor device 212 is activated to an extended position so that the sensor device 26 contacts the target reservoir 204. In the preferred embodiment, the means of activating the extendible sensor device is through the two steps hydraulic method previously described. The soluble compound coating the sensor device 212 having a filter media 136 will then be dissolved by pumping an acid solution down the inner diameter of the workstring 209. Because the packer member 210 is set, the acid solution will be diverted through the inner diameter of the work-string 209 and into the sensor device 212 establishing fluid communication with the production zone 204.

Thus, once the sensor device 212 is extended and the soluble compound dissolved, the hydrocarbon zone 204 may be tested by flowing the target reservoir 204 by opening up the valve 211. Multiple flow and pressure build-up tests may be performed by opening and closing the valve 211.

As can be seen by one skilled in the art, obtaining "real time" data for surface manipulation of a certain operation using such data greatly improves efficiency while eliminating certain procedures entirely. In the alternative, localized operations are similarly performed by analyses of incoming data in closed loop operations using a microprocessor 141 and control mechanisms.

Testing other hydrocarbon zones may be similarly accomplished by moving the workstring to the intermediate zone position using the sensor 135 located in each sensor device. The isolation packer 210 member is then set at the appropriate depth using the electronic control system previously described for isolating the wellbore. The isolation packer 210 member is located at a position above the lower target zone 204 and the intermediate target zone 206, and allowing flow from both the lower target reservoir 204 and the intermediate target zone 206. Necessary flowing periods followed by shut-in periods as is well known in the art may be also accomplished using the data obtained through the sensor 136 in a given sensor device. Again obtaining data for a particular characteristic clearly provides advantages over prior art technology for performing similar operations.

Alternately, as seen in FIG. 6, the method may further comprise the step of shutting-in a particular target zone such as, for example, zone 204 in FIG. 6 by an isolating member (not shown) such as a through-tubing bridge plug. The through-tubing bridge plug is run through the work-string 209 and positioned above the reservoir 204 so that the lower zone is now isolated.

Alternately, a plurality of balls that fit and seal-off the sensor device along the circumference surface 132 may be pumped down to isolate it. The packer member 210 is re-set at a repositioned up-hole position indicated at 226 in FIG. 6 under these operations. The sensor device 214 is then hydraulically extended as already described. The soluble barrier 134 may be dissolved by pumping an acid slurry. Again, a flowing and pressure build-up test may be performed by manipulation of the valve 211. If it is determined that some of the perforations require acidizing because of poor hydrocarbon flow, then it may be necessary to pump a plurality of diverting balls (not shown). These diverting balls would seek out and seal those sensor devices having poor flow conditions as previously described herein by monitoring low pressure drops. The acid is diverted to those devices having high pressure drops to dissolve clogging material to thus improve flow conditions. Once again obtaining data for a particular characteristic clearly provides advantages over prior art technology for performing similar operations.

Changes and modifications in the specifically described embodiments may be carried out without departing from the scope of the invention which is intended to be limited only by the scope of the appended claims.

I claim:

1. A device for monitoring a reservoir in a wellbore, said wellbore having at least one target formation and having a tubular member comprising casing or production tubing; said device for monitoring further comprising:

at least one sensor comprising an information retrieval device, being mounted on the tubular member on a probe such that said sensor is retained substantially within said tubular member until it is positioned adjacent the target formation whereupon said probe is extendable with said sensor to position said sensor adjacent the target formation for gathering wellbore characteristic data therefrom.

2. The device of claim 1, further comprising:

a plurality of sensors mounted in a predetermined symmetrical pattern along the length of the tubular member.

3. The device of claim 1, further comprising:

a plurality of sensors mounted on the tubular member for monitoring a hydrocarbon reservoir in the target formation.

4. The device of claim 1, further comprising:

a plurality of sensors mounted on the tubular member for monitoring reservoir fluid in the target formation.

5. The device of claim 1, further comprising:

a plurality of sensors mounted on the tubular member at predetermined angular positions around the tubular member.

6. The device of claim 5 wherein:

said plurality of sensors are positioned around the tubular member in an isotropic manner for sensing formation characteristics in all directions of the wellbore.

7. The device of claim 1, further comprising:

a plurality of sensors positioned on the tubular member in a straight line along a portion of the tubular member's axial length.

8. The device of claim 1, further comprising:

a plurality of sensors in a plurality of probes which measure resistivity of the formation when extended toward the sidewall of the wellbore.

9. The device of claim 1 wherein:

the sensor comprises an information retrieval device capable of monitoring chemical, mechanical, electrical or heat energy located in an area adjacent the sensor.

10. The device of claim 1 wherein the sensor monitors any one of the following wellbore characteristics:

temperature, pressure, fluid flow, fluid type, resistivity, cross-well acoustics, cross-well seismic, perforation depth, fluid characteristic or logging data.

11. The device of claim 1 wherein:

said sensor transmits a sensed wellbore characteristic data signal to a microprocessor at a surface location.

12. The device of claim 1 further comprising:

a memory device located on the tubular member for storing the wellbore characteristic data signal received from said sensor.

13. The device of claim 1 wherein said sensor is located on the production tubing in an open-hole wellbore completion.

14. The device of claim 1 wherein said sensor is located on the casing in a cased-hole wellbore completion.

15. A device for monitoring a reservoir in a wellbore comprising:

a tubular member being received in the wellbore adjacent a target formation;

one or more screen liners mounted along the tubular member;

at least one sensor, comprising an information retrieval device, being mounted on the tubular member and positioned at predetermined intervals along the length of the tubular member;

at least one sensor, each comprising an information retrieval device, being mounted on screen liner and positioned at predetermined intervals along the length of the liner; and the tubular member being positioned in the wellbore to extend adjacent the target formation for gathering wellbore characteristic data therefrom.

16. An apparatus, for performing wellbore testing, completion or production, which is in communication with a target reservoir in a wellbore comprising:

a tubular pipe having an aperture for communicating with the target reservoir;

at least one flow control device moveably mounted within the aperture of the tubular pipe for receiving fluid flow from the wellbore comprising:

a tubular member moveably mounted on the tubular pipe for movement in a direction generally along the tubular member's longitudinal axis between a retracted position primarily within the tubular pipe and an extended position towards a sidewall of the wellbore near the target reservoir; and, a sensor device located in the tubular member for selectively monitoring a wellbore parameter.

17. The apparatus of claim 16, wherein:

said tubular member further comprising a filter media therein; and said tubular member being selectively operable in a first mode blocking fluid flow and in a second mode enabling fluid flow from the target reservoir into the tubular pipe.

18. The apparatus of claim 17 wherein:

the flow control device selectively monitors the wellbore parameter independently of whether the side-wall of the wellbore engages the flow control device.

19. The apparatus of claim 17 wherein:

the sensor device comprises an information retrieval device capable of converting electrical, chemical, mechanical or heat energy into an electronic signal.

20. The apparatus of claim 17 wherein:

the sensor device comprises at least one from a group of the following: seismic receiver, an acoustic receiver or a mechanical receiver.

21. The apparatus of claim 17 wherein:

the flow control device monitors any one of the following wellbore parameters: temperature, pressure, fluid flow, fluid type, resistivity, cross well resistivity, perforation depth, fluid characteristic or logging data.

22. The apparatus of claim 17 wherein:

the sensor device transmits a wellbore parameter data signal to a microprocessor at a surface location.

23. The apparatus of claim 22 wherein:

the microprocessor after processing the received wellbore parameter data signal transmits a signal to implement a control instruction to a downhole control device.

24. The apparatus of claim 17 wherein:

the sensor device transmits a wellbore parameter data signal to a memory device located on the tubular pipe for storage of the data signal.

25. The apparatus of claim 17 further comprising:

a microprocessor located downhole on the tubular pipe, after processing a received wellbore parameter signal from the sensor device, transmits a signal to a downhole control device to implement a control instruction.

26. The apparatus of claim 25 wherein:

the microprocessor transmits the processed data signal to the surface along with a request for approval from the surface location to implement the control instruction.

27. The apparatus of claim 26 wherein:

the surface location transmits a decision signal to the microprocessor to either implement or ignore the control instruction.

28. The apparatus of claim 25 wherein:

the surface location transmits an action signal to the microprocessor to perform a required action independent of the processed data signals.

29. The apparatus of claim 17 wherein:

the filter media comprises a plurality of beads consolidated by a bonding agent to form a fluid permeable core.

30. The apparatus of claim 17 wherein:

the consolidated beads comprise a metal alloy and the bonding agent is a brazing powder.

31. The apparatus of claim 17 wherein:

the filter media further comprises a dissolvable material located in interstitial pores of the filter media for preventing fluid flow when present in the filter media.

32. The apparatus of claim 17, further comprising:

a plurality of flow control devices containing sensor devices, said flow control devices disposed on the tubular pipe.

33. A method of wellbore completion, including a method for monitoring a wellbore parameter during hydrocarbon production, comprising:

positioning a tubular into a wellbore, having a sensor device movably mounted for receiving a wellbore parameter signal and having fluid communication with a target reservoir;

correlating the position of the sensor device with the target reservoir so that the sensor device is adjacent the target reservoir;

extending the sensor device toward the target reservoir from a retracted position to an extended position;

sensing a wellbore parameter signal from the subterranean formation by way of the sensor device;

transmitting the wellbore parameter signal from the sensor device to a microprocessor;

processing the wellbore parameter signal with the microprocessor; and transmitting a control signal from the microprocessor to a control device located downhole for carrying out a command instruction.

34. The method of claim 33, further comprising:

providing selective communication into the tubular through said sensor device;

enabling selective flow into the tubular past said sensor device;

receiving a wellbore parameter signal from the reservoir fluid in the formation.

35. The method of claim 34 further comprises:

transmitting the processed data signals to the surface location along with a request for approval from the surface location to implement the control instruction.

36. The method of claim 35 further comprises:

transmitting a decision signal from the surface location to the microprocessor to either implement or ignore the control instruction.

37. The method of claim 33 further comprises:

transmitting an action signal from the surface to the microprocessor to perform a required action independent of the processed data signals.

38. A method of testing an exploratory well leading to a target reservoir, comprising:

positioning in the exploratory wellbore a tubular having at least one flow control device for receiving selective fluid communication from an adjacent target reservoir, the flow control device comprising:

an extendible member, containing a filter media allowing selective fluid flow, extendible from within the casing string in a retracted position to an expanded position toward the wellbore wall;

a sensor device located within the extendible member for receiving wellbore parameter signals;

correlating the position of the flow control device so that it is adjacent the target reservoir;

activating the flow control device so that the extendible member moves toward the wellbore wall;

testing the hydrocarbon zone by flowing the target reservoir through the filter media into the; tubular receiving a wellbore parameter signal using said sensor device;

transmitting the wellbore parameter signal to a microprocessor and processing the signal; and sending a control instruction to a control device located within the wellbore for performing a control operation.

39. The method of claim 38 further comprises:

transmitting the processed data signal to the surface location along with a request for approval from the surface location to implement the control instruction.

40. The method of claim 39 further comprises:

transmitting a decision signal from the surface location to the microprocessor to either implement or ignore the control instruction.

41. The method of claim 38 further comprises:

transmitting an action signal from the surface to the microprocessor to perform a required action independent of the processed data signals.

42. The method of claim 38, wherein the exploratory well contains a lower, an intermediate, and an upper target reservoir, and wherein the tubular is positioned in the wellbore so that flow control devices correspond to depths of the lower, intermediate and upper target reservoirs and wherein the method of testing each of the hydrocarbon zones comprises:

lowering a tubular string having thereon a control device comprising an isolation packer for isolating the wellbore;

setting the isolation packer at a position above the lower target reservoir but below the intermediate target reservoir;

flowing hydrocarbon production into the tubular from the lower target reservoir by activating at least one flow control device adjacent to it.

43. The method of claim 42, further comprising:

shutting-in the well by activating a bridge plug in the well at a point above the lower target reservoir;

releasing and repositioning the isolation packer to a point above the intermediate reservoir;

setting the isolation packer at a position above the intermediate target reservoir;

flowing hydrocarbon production into the casing string from the intermediate target reservoir by activating at least one flow control device adjacent to it.

44. The method of claim 43, further comprising:

shutting-in the well by activating a bridge plug in the well at a point above the intermediate target reservoir;

releasing and repositioning the isolation packer to a point above the highest reservoir;

setting the isolation packer at a position above the highest target reservoir;

flowing hydrocarbon production into the casing string from the highest target reservoir by activating at least one flow control device adjacent to it.

45. A device for monitoring a reservoir in a wellbore, said wellbore having at least one target formation and having a tubular member comprising casing or production tubing; said device for monitoring further comprising:

at least one sensor comprising an information retrieval device, being mounted on the tubular member and positioned on the tubular member adjacent the target formation for gathering wellbore characteristic data therefrom;

at least one extendible probe mounted on the tubular member having a sensor, said probe extended toward the sidewall of the wellbore when it is in a fully extended position; and said probe receives fluid flow from an adjacent formation.

46. The device of claim 45 wherein:

the extendible probe is operatively associated with a flow control mechanism for preventing flow in a first mode and permitting flow in a second mode.

47. The device of claim 45 wherein:

the extendible probe is operatively associated with a flow control device for variably controlling the flow rate into the tubular member from the adjacent formation.

48. A device for monitoring a reservoir in a wellbore, said wellbore having at least one target formation and having a tubular member comprising casing or production tubing; said device for monitoring further comprising:

at least one sensor comprising an information retrieval device, being mounted on the tubular member and positioned on the tubular member adjacent the target formation for gathering wellbore characteristic data therefrom;

at least one housing defining a flow passage into the tubular member for receiving fluid flow from the reservoir and wherein said housing contains a filter media for retention of at least some of the particulate matter; and wherein said housing has a sensor in said housing for sensing fluid properties.

49. A device for monitoring a reservoir in a wellbore, said wellbore having at least one target formation and having a tubular member comprising casing or production tubing; said device for monitoring further comprising:

at least one sensor comprising an information retrieval device, being mounted on the tubular member and positioned on the tubular member adjacent the target formation for gathering wellbore characteristic data therefrom;

said sensor transmits a sensed wellbore characteristic data signal to a microprocessor at a surface location; and the microprocessor, after processing the received wellbore characteristic data signal, transmits a signal to implement a control instruction to a downhole control device.

50. A device for monitoring a reservoir in a wellbore, said wellbore having at least one target formation and having a tubular member comprising casing or production tubing; said device for monitoring further comprising:

at least one sensor comprising an information retrieval device, being mounted on the tubular member and positioned on the tubular member adjacent the target formation for gathering wellbore characteristic data therefrom;

a microprocessor mounted with said sensor for processing at least one data signal received from said sensor and for transmitting said signal to implement a control instruction to a downhole control device.

51. The device of claim 50 wherein:

the microprocessor transmits said processed data signals to the surface along with a request for approval from the surface location to implement the control instruction.

52. The device of claim 51 wherein:

the surface location transmits at least one decision signal to the microprocessor to either implement or ignore the control instruction.

53. The device of claim 51 wherein:

the surface location transmits at least one action signal to the microprocessor to perform a required action independent of the processed data signals.

* * * * *